US006491170B1

(12) United States Patent
Madela

(10) Patent No.: US 6,491,170 B1
(45) Date of Patent: Dec. 10, 2002

(54) DRYING AND ORGANIZING RACK FOR KITCHEN UTENSILS, FLATWARE AND CHINA

(76) Inventor: Florendo Madela, 44520 Fenhold St., Lancaster, CA (US) 93535

( * ) Notice: Subject to any disclaimer, the term of this patent is extended or adjusted under 35 U.S.C. 154(b) by 0 days.

(21) Appl. No.: 09/872,028

(22) Filed: Jun. 1, 2001

(51) Int. Cl.[7] ..... A47G 19/00
(52) U.S. Cl. ..... 211/41.3
(58) Field of Search ..... 211/41.3, 126.1, 211/128.1; D32/55, 56, 58, 59

(56) References Cited

U.S. PATENT DOCUMENTS 4,531,641 A * 7/1985 Archambault ..... 211/41.3
5,158,184 A * 10/1992 Craft et al. ..... 211/41.3
D368,412 S * 4/1996 Lin ..... D7/637
6,119,736 A * 9/2000 Huang et al. ..... 141/86

* cited by examiner

*Primary Examiner*—Robert W. Gibson, Jr.
*Assistant Examiner*—Erica B. Harris
(74) *Attorney, Agent, or Firm*—Goldstein & Lavas, P.C.

(57) ABSTRACT

A drying and organizing rack for kitchen utensils, flatware and china includes a support member comprised of a square lower platform having four leg members coupled therewith. The four leg members have lower ends\positionable on a recipient surface and upper ends disposed above the lower platform. At least two square trays are secured to the four leg members of the support member in a spaced relationship. The upper tray is defined by an open upper end, a lower end, and a peripheral side wall. The lower end has a drainage aperture therethrough. The open upper end has a plurality of compartments formed therein. The plurality of compartments dimensioned for receiving utensils, flatware, and china therein. The peripheral side wall has a plurality of cup hooks secured thereto.

4 Claims, 2 Drawing Sheets

DRYING AND ORGANIZING RACK FOR KITCHEN UTENSILS, FLATWARE AND CHINA

BACKGROUND OF THE INVENTION

The present invention relates to a drying and organizing rack for kitchen utensils, flatware and china and more particularly pertains to holding utensils, flatware, and china in an organized manner while drying.

The use of kitchen utensil holding devices is known in the prior art. More specifically, kitchen utensil holding devices heretofore devised and utilized for the purpose of holding kitchen utensils are known to consist basically of familiar, expected and obvious structural configurations, notwithstanding the myriad of designs encompassed by the crowded prior art that have been developed for the fulfillment of countless objectives and requirements.

By way of example, U.S. Pat. No. 5,392,923 to Hassard discloses a multiple article organizer device with a plurality of levels. U.S. Pat. Nos. 4,632,347 to Jurgich and U.S. Pat. Nos. 4,870,754 to Chiou disclose various kitchen utensil holders. U.S. Pat. No. Des. 334,317 to So discloses the ornamental design for a kitchen utensil holder.

While these devices fulfill their respective, particular objectives and requirements, the aforementioned patents do not describe a drying and organizing rack for holding kitchen utensils, flatware, and china in an organized manner while drawing.

In this respect, the drying and organizing rack for kitchen utensils, flatware and china according to the present invention substantially departs from the conventional concepts and designs of the prior art, and in doing so provides an apparatus primarily developed for the purpose of holding utensils, flatware, and china in an organized manner while drying.

Therefore, it can be appreciated that there exists a continuing need for a new and improved drying and organizing rack for kitchen utensils, flatware and china that can be used for holding utensils, flatware, and china in an organized manner while drying. In this regard, the present invention substantially fulfills this need.

SUMMARY OF THE INVENTION

In view of the foregoing disadvantages inherent in the known types of kitchen utensil holding devices now present in the prior art, the present invention provides an improved drying and organizing rack for kitchen utensils, flatware and china. As such, the general purpose of the present invention, which will be described subsequently in greater detail, is to provide a new and improved drying and organizing rack for kitchen utensils, flatware and china that has all the advantages of the prior art and none of the disadvantages.

To attain this, the present invention essentially comprises a support member consisting of a square lower platform having four leg members coupled therewith. The four leg members have lower ends\positionable on a recipient surface and upper ends disposed above the lower platform. A square upper tray is secured to the upper ends of the four leg members of the support member. The upper tray is defined by an open upper end, a lower end, and a peripheral side wall. The lower end is slanted toward a central portion thereof. The central portion has a drainage aperture therethrough. The drainage aperture is in communication with a water outlet tray secured to a lower surface of the lower end.

The water outlet tray has an open outer end for positioning adjacent to a sink. The open upper end has a plurality of compartments formed therein. The plurality of compartments include plate compartments and a main utensil compartment. The peripheral side wall has a plurality of cup hooks secured thereto. A square lower tray is secured to the four leg members of the support member below the upper tray. The lower tray is defined by an open upper end, a lower end, and a peripheral side wall. The lower end is slanted toward intermediate portion thereof. The intermediate portion has a drainage aperture therethrough. The drainage aperture is in communication with a water outlet tray secured to a lower surface of the lower end. The water outlet tray has an open outer end for positioning adjacent to a sink. The open upper end has a plurality of compartments formed therein. The plurality of compartments include compartments for bowls, flatware, and drinking glasses.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved drying and organizing rack for kitchen utensils, flatware and china that has all the advantages of the prior art kitchen utensil holding devices and none of the disadvantages.

It is another object of the present invention to provide a new and improved drying and organizing rack for kitchen utensils, flatware and china that may be easily and efficiently manufactured and marketed.

It is a further object of the present invention to provide a new and improved drying and organizing rack for kitchen utensils, flatware and china that is of durable and reliable construction.

An even further object of the present invention is to provide a new and improved drying and organizing rack for kitchen utensils, flatware and china that is susceptible of a low cost of manufacture with regard to both materials and labor, and which accordingly is then susceptible of low prices of sale to the consuming public, thereby making such a drying and organizing rack for kitchen utensils, flatware and china economically available to the buying public.

Even still another object of the present invention is to provide a new and improved drying and organizing rack for kitchen for holding kitchen utensils, flatware, and china in an organized manner while drying, Lastly, it is an object of the present invention to provide a new and improved drying and organizing rack for holding kitchen utensils, flatware and china including a support member consisting of a square lower platform having four leg members coupled therewith. The four leg members have lower ends\positionable on a recipient surface and upper ends disposed above the lower platform. At least two square trays secured to the four leg members of the support member in a spaced relationship. The upper tray is defined by an open upper end, a lower end, and a peripheral side wall. The lower end has a drainage aperture therethrough. The open upper end has a plurality of compartments formed therein. The plurality of compartments dimensioned for receiving utensils, flatware, and china therein. The peripheral side wall has a plurality of cup hooks secured thereto.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

With reference now to the drawings, the preferred embodiment of the new and improved drying and organizing rack for kitchen utensils, flatware and china embodying the principles and concepts of the present invention and generally designated by the reference number 10 will be described.

Specifically, it will be noted in the various figures that the device relates to a drying and organizing rack for holding kitchen utensils, flatware, and china in an organized manner while drying. In its broadest context, the device consists of a support member, a square upper tray, and a square lower tray. Such components are individually configured and correlated with respect to each other so as to attain the desired objective.

Figure 1:
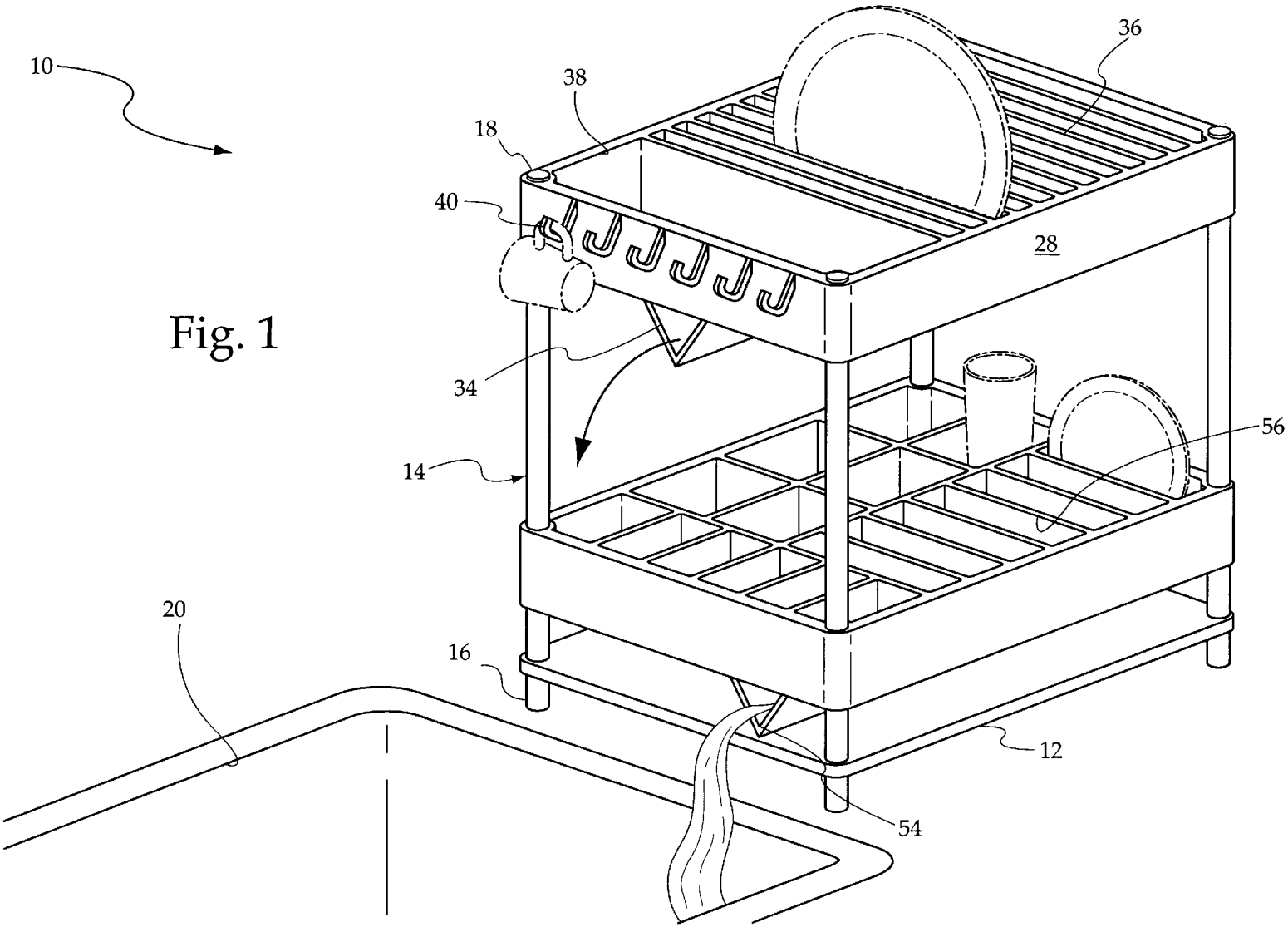
FIG. 1 is a perspective view of the preferred embodiment of the drying and organizing rack for kitchen utensils, flatware and china constructed in accordance with the principles of the present invention.
Figure 2:
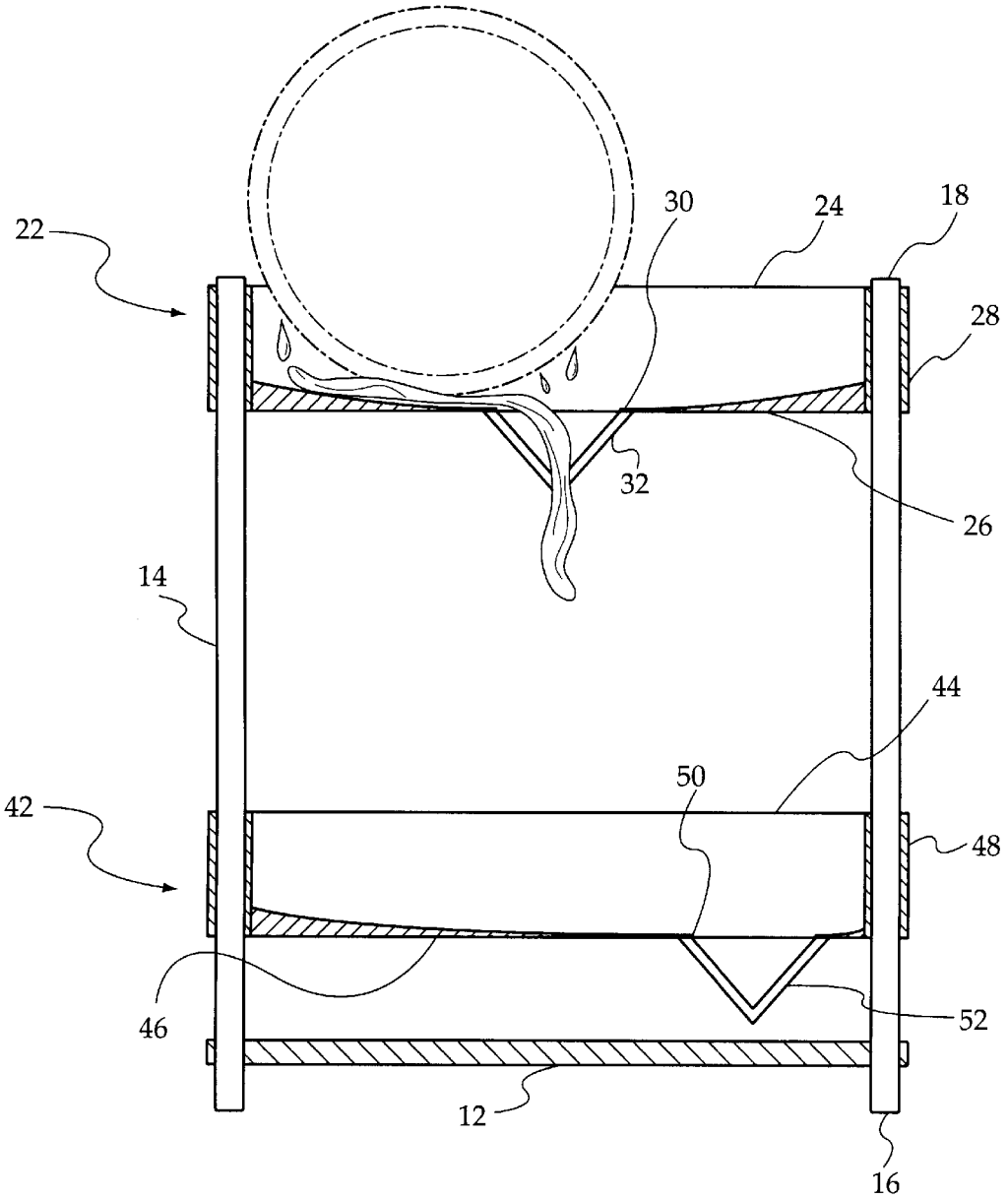
FIG. 2 is a side view of the present invention illustrated in cross-section.

The support member consists of a square lower platform 12 having four leg members 14 coupled therewith. The four leg members 14 have lower ends 16 positionable on a recipient surface and upper ends 18 disposed above the lower platform 12. In use, the support member is positioned adjacent to a sink 20 in a manner similar to standard drying racks. Note FIG. 1.

The square upper tray 22 is secured to the upper ends 18 of the four leg members 14 of the support member. The upper tray 22 is defined by an open upper end 24, a lower end 26, and a peripheral side wall 28. The lower end 26 is slanted toward a central portion thereof. The central portion has a drainage aperture 30 therethrough. The drainage aperture 30 is in communication with a water outlet tray 32 secured to a lower surface of the lower end 26. The water outlet tray 32 has an open outer end 34 for positioning adjacent to a sink 20. The open upper end 24 has a plurality of compartments formed therein.

The plurality of compartments include plate compartments 36 and a main utensil compartment 38. The peripheral side wall 28 has a plurality of cup hooks 40 secured thereto.

The square lower tray 42 is secured to the four leg members 14 of the support member below the upper tray 22. The lower tray 42 is defined by an open upper end 44, a lower end 46, and a peripheral side wall 48. The lower end 46 is slanted toward a an intermediate portion thereof. The intermediate portion has a drainage aperture 50 therethrough. The drainage aperture 50 is in communication with a water outlet tray 52 secured to a lower surface of the lower end 46. The water outlet tray 52 has an open outer end 54 for positioning adjacent to a sink 20. The open upper end 44 has a plurality of compartments 56 formed therein. The plurality of compartments 56 include compartments for bowls, flatware, and drinking glasses.

In use the present invention would be positioned adjacent to the sink 20 so that recently washed dishes and the like can drain into the sink 20. The present invention allows all types of utensils, flatware, plates, mugs, and glasses to be organized in a manner that will allow them to be removed and replaced in their proper position in a kitchen cabinet or the like.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A drying and organizing rack for holding kitchen utensils, flatware, and china in an organized manner while drying, the rack comprising, in combination:

a support member comprised of a square lower platform having four leg members coupled therewith, the four leg members having lower ends\positionable on a recipient surface and upper ends disposed above the lower platform;

a square upper tray secured to the upper ends of the four leg members of the support member, the upper tray being defined by an open upper end, a lower end, and a peripheral side wall, the lower end being slanted toward a central portion thereof, the central portion having a drainage aperture therethrough, the drainage aperture being in communication with a water outlet tray secured to a lower surface of the lower end, the water outlet tray having an open outer end for positioning adjacent to a sink, the open upper end having a plurality of compartments formed therein, the plurality of compartments including plate compartments and a main utensil compartment, the peripheral side wall having a plurality of cup hooks secured thereto; and a square lower tray secured to the four leg members of the support member below the upper tray, the lower tray being defined by an open upper end, a lower end, and a peripheral side wall, the lower end being slanted toward an intermediate portion thereof, the intermediate portion having a drainage aperture therethrough, the drainage aperture being in communication with a water outlet tray secured to a lower surface of the lower end, the water outlet tray having an open outer end for positioning adjacent to a sink, the open upper end having a plurality of compartments formed therein, the plurality of compartments including compartments for bowls, flatware, and drinking glasses.

2. A drying and organizing rack for holding kitchen utensils, flatware, and china in an organized manner while drying, the rack comprising, in combination:

a support member comprised of a square lower platform having four leg members coupled therewith, the four leg members having lower ends\positionable on a recipient surface and upper ends disposed above the lower platform;

at least an upper and lower tray, secured to the four leg members of the support member in a vertically spaced relationship, each tray being defined by an open upper end, a lower end, and a peripheral side wall, the lower end having a drainage aperture therethrough, the open upper end having a plurality of compartments formed therein, the plurality of compartments being dimensioned for holding utensils, flatware, and china, and the peripheral side wall of at least one of said trays having a plurality of cup hooks secured thereto.

3. The drying and organizing rack for holding kitchen utensils, flatware and china as set forth in claim 2, wherein the closed lower ends of the trays are slanted toward the drainage aperture therethrough.

4. The drying and organizing rack for kitchen utensils, flatware and china as set forth in claim 2, wherein the drainage aperture is in communication with a water outlet tray secured to a lower surface of the lower end, the water outlet tray having an open outer end for positioning adjacent to a sink.

* * * * *